US006415999B1

(12) United States Patent
Nied

(10) Patent No.: US 6,415,999 B1
(45) Date of Patent: Jul. 9, 2002

(54) CUTTING MILL

(76) Inventor: Roland Nied, Raiffeisen-Stra e 10, D-84684 Bonstetten (DE)

( * ) Notice: Subject to any disclaimer, the term of this patent is extended or adjusted under 35 U.S.C. 154(b) by 0 days.

(21) Appl. No.: 09/710,232

(22) Filed: Nov. 10, 2000

(30) Foreign Application Priority Data

Nov. 16, 1999 (DE) ..... 199 54 998

(51) Int. Cl.[7] ..... B02C 23/32

(52) U.S. Cl. ..... 241/79.1; 241/80; 241/242; 241/286

(58) Field of Search ..... 241/79.1, 242, 241/80, 97, 286, 294

(56) References Cited

U.S. PATENT DOCUMENTS 2,552,037 A * 5/1951 Elverum ..... 241/242

* cited by examiner

*Primary Examiner*—Mark Rosenbaum
(74) *Attorney, Agent, or Firm*—Levine & Mandelbaum

(57) ABSTRACT

A cutting mill has a cutting rotor and a rotatable sizing means, arranged together with the cutting rotor in a common housing.

8 Claims, 2 Drawing Sheets

CUTTING MILL

BACKGROUND OF THE INVENTION

Cutting mills have been known and used to comminute plastic wastes and corresponding cuttable materials in the form of chunks, hollow bodies, films and profiled materials, but also natural and synthetic rubber, vulcanized rubber, cable wastes, glass fiber wastes, leather or paper.

A drum-like cutting chamber as a stator surrounds a cutting rotor, which is arranged concentrically in the cutting chamber and beyond the outer circumference of which radially arranged cutting knives project with their outer ends, between which and the wall of the cutting chamber a cutting gap is located. The cutting knives arranged uniformly on the circumference of the rotor are radially adjustable in relation to the rotor in order to set the width of the cutting gap.

One section of the cutting chamber wall is designed as a screen, through which the cut material enters a chamber, from which it is removed from the mill, e.g., by drawing off, for further use. The screen forms a sizing means, because the mesh size of the screen determines when the cut material has reached the intended final smallness. Cut material below an intended limit value leaves the cutting mill through the screen for removal from the mill, while the material above the limit value rotates in the cutting mill and is subjected to the action of the knives until it can pass through the screen because of the smaller size it has reached.

Prior-art cutting mills of this design have hitherto been developed based on the criteria reliability in continuous operation, economical operation due to high performance and low energy consumption as well as low maintenance requirements.

SUMMARY OF THE INVENTION

The present invention is based on the recognition of shortcomings of such mills, which are caused by the sizing means. Even though the screen as a section of the cutting chamber wall is a simple component, a changeover of the mill to another degree of size reduction of the material to be cut is not possible with it because of the lack of variability of the mesh size and the replacement of the screen with a screen of a different mesh size or because the screen has reached its service life is complicated and time-consuming and means a long down time of the machine.

The object of the present invention is to propose a cutting mill which has marked advantages over the prior-art cutting mills concerning the sizing means.

The essence of the present invention is above all that in an otherwise known cutting mill, the sizing means is a rotating sizing means, which is associated with the cutting rotor and stator in a common housing.

The present invention offers the advantage that the cutting means, on the one hand, and the sizing means, on the other hand, are components of a single device, but the components are independent from one another to the extent that the sizing means can be adapted to the particular operating conditions substantially better than in the state of the art, and the replacement of a less sizing means with a more suitable one may be possible in a relatively simple manner.

A preferred embodiment of the present invention will be described below on the basis of the drawing.

DESCRIPTION OF THE PREFERRED EMBODIMENT

Figure 1:
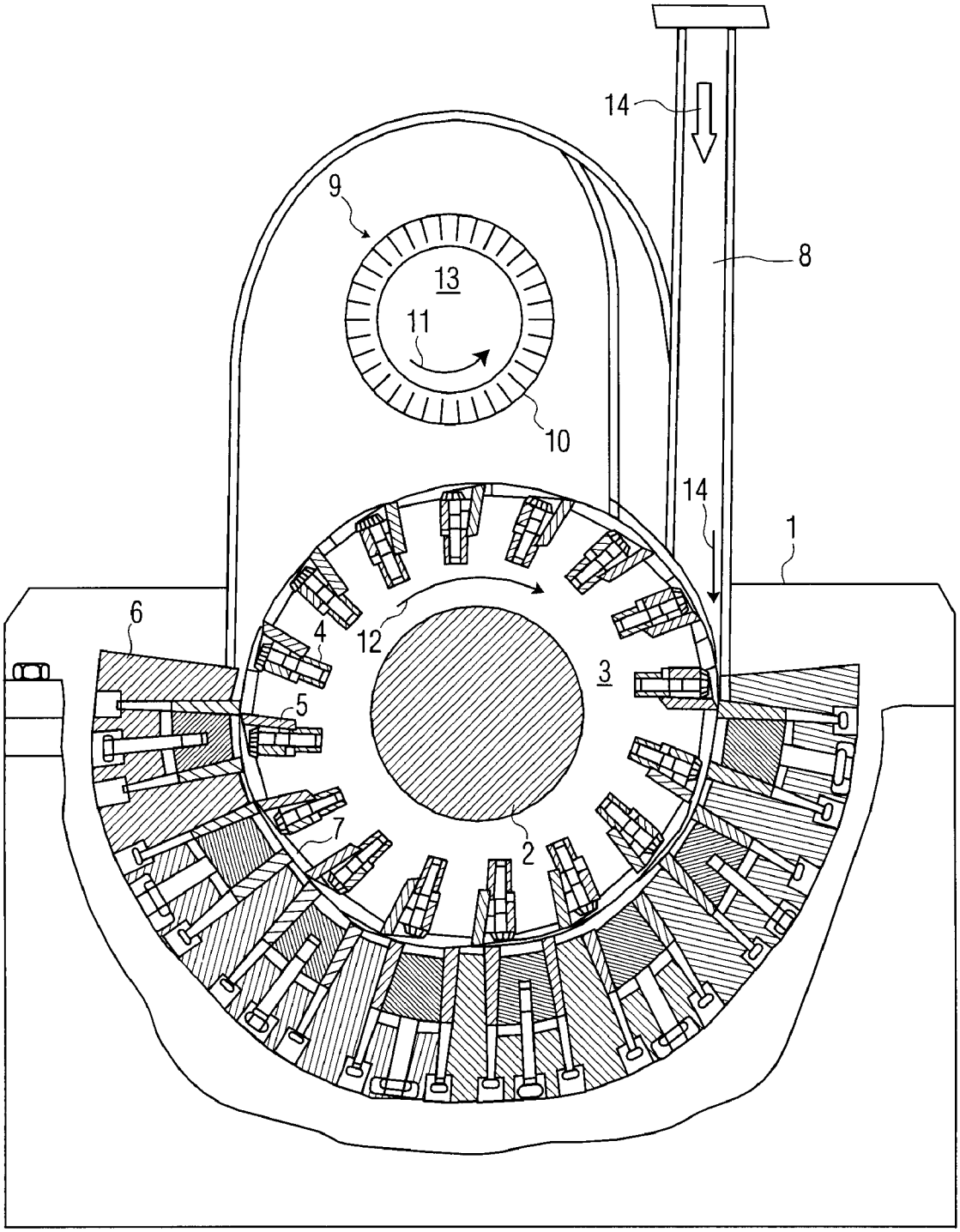
FIG. 1 of the drawings shows the central longitudinal section of a cutting mill designed according to the present invention.

The multi-knife rotor 3 is arranged rotatably around the longitudinal axis of a horizontal shaft 2 in the lower area of a stationary cutting mill housing 1. The rotor 3 is equipped with a total of 16 knives 4, which are directed radially and are held adjustably in the radial direction in guides 5 of the rotor 3. The knives project with their outer ends beyond the outer circumferential surface of the rotor 3, and this measure can be set by adjusting the knives in their guides. The cutting gap 7, whose width can be determined and set appropriately by adjusting the knives 4, is located between the outer ends of the knives 4 and the inner surface of the mill stator 6 arranged in the housing 1.

The gap width to be set depends on the material to be cut, as was mentioned above as an example. The material to be cut is fed into the cutting gap 7 through a feed pipe 8, which is introduced into the cutting mill housing and through which the material to be cut, which is suspended in air, is introduced. The mill is a usual cutting mill to this extent, so that its further detailed description is not necessary.

Figure 1A:
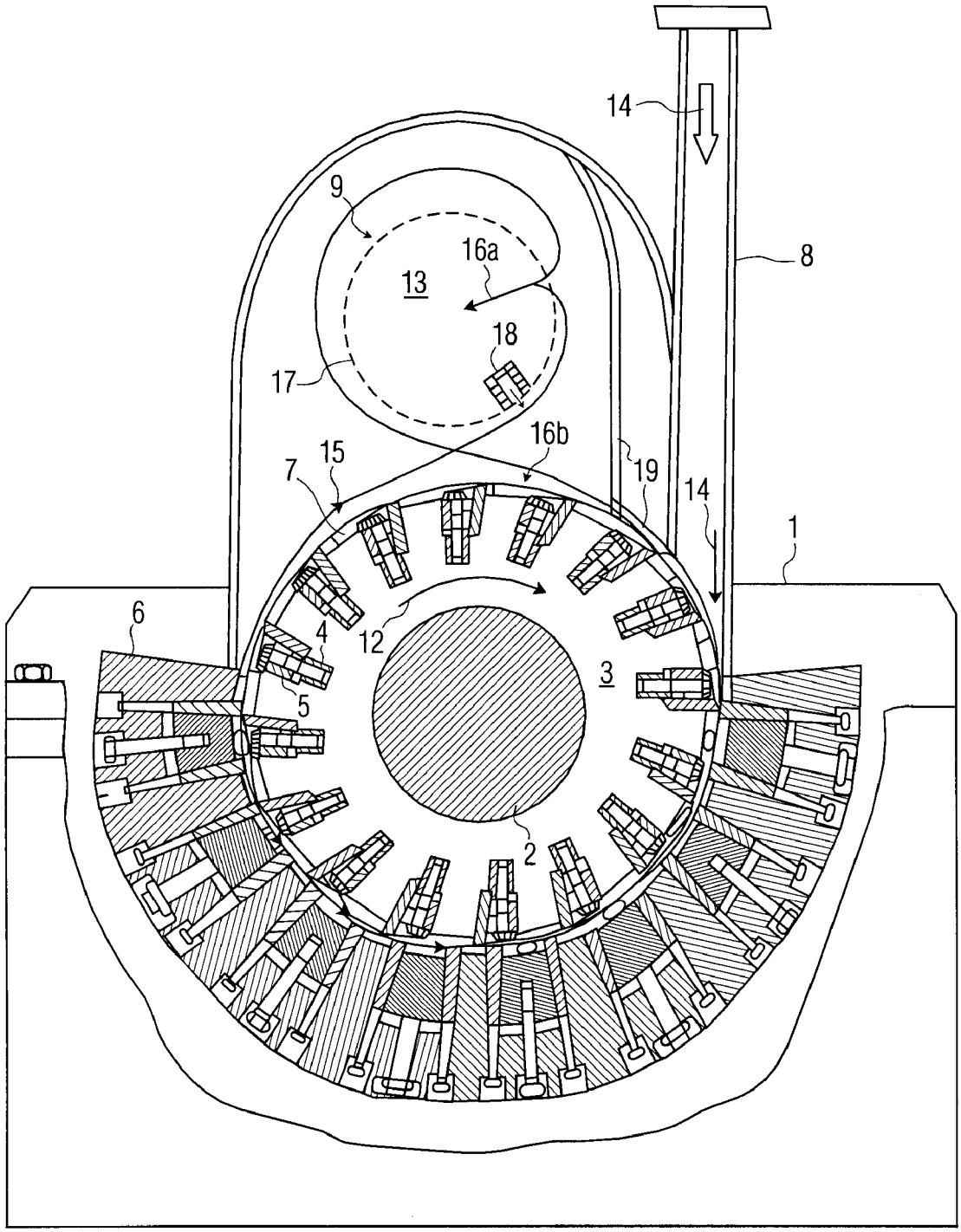
FIG. 1*a* of the drawings shows the central longitudinal section of a cutting mill according an alternate embodiment of the present invention.

The sizing means 9 following the cutting rotor in the direction of flow is essentially a sizing rotor 10 arranged essentially with parallel axes to the cutting rotor 1 above this cutting rotor, and the cutting rotor 3 and the sizing rotor 10 should preferably have mutually opposite directions of rotation (arrows 11, 12), even though cases in which both rotors 3 and 10 have the same direction of rotation are conceivable as well (See FIG. 1). Instead of the sizing rotor 10, a stationarily installed air jet screen 17 may also be provided without this needing to be specifically explained (See FIG. 1*a*).

The sizing rotor or the correspondingly drum-shaped air jet screen surrounds a suction space 13, into which the cut material enters after passing through the sizing rotor or the screen in order to be drawn off from the suction space 13 by means of vacuum and to be further used.

The cut material which is rejected by the sizing means as a material which has not yet been cut to the sufficient fineness reenters the cutting gap 7 in order to be subjected to a second and optionally additional cutting processes.

The path of the material to be cut through the feed pipe 8 into the cutting gap 7 is indicated by arrows 14; the path of the cut material from the cutting gap into the suction space is indicated by the arrows 15, 16*a*, and, finally, the return of the cut material that has not yet reached the intended final size is indicated by the arrows 15, 16*b*.

Additional features embodying the present invention in a suitable manner are as follows.

If the sizing means is designed as a drum-shaped air jet screen 17, a stationarily arranged cleaning nozzle 18 is associated herewith in order to always guarantee a clean passage through the screen.

A closing wedge 19, which prevents the cut material from flowing back, is arranged in the circulating area, i.e., cutting gap.

Two sizing rotors with mutally opposite suction directions are optionally arranged on a common shaft to achieve a two-step sizing.

If the sizing means is an air separator, through the blade or flow channels of which the material to be sized flows from the outside to the inside, the separator capacity can be set by changing the suction vacuum and/or the speed of rotation of the separator wheel.

What is claimed is:

1. A cutting mill comprising, a housing, said housing having a lower part with a stator having a circumferential inner surface, and an upper part defining a chamber therewithin, a multi-knive rotor having a circumferential outer surface and a plurality of radially adjustable knives distributed uniformly about its circumference, said knives having inner ends guided within said rotor and outer ends projecting beyond the outer circumferential surface of said rotor for determining the width of a cutting gap between said rotor and stator, a horizontal shaft mounted within said lower part of said stationary cutting mill housing and having an axis about which said multi-knive rotor is rotatable, and cylindrical sizing means disposed above said multi-knive rotor within said chamber, and rotatable about an axis parallel to and in vertical alignment with the axis of said horizontal shaft.

2. A cutting mill in accordance with claim 1, wherein the rotor and sizing means are rotatable around respective axes which are offset in relation to one another and parallel to one another.

3. A cutting mill in accordance with claim 1, wherein the rotor and sizing means have opposite directions of rotation.

4. A cutting mill in accordance with claim 1 further comprising a chamber surrounded by said sizing means, from which cut material passing through the sizing means against the effect of centrifugal force is drawn off for further use.

5. A cutting mill in accordance with claim 1 wherein the sizing means comprises an air jet screen.

6. A cutting mill in accordance with claim 5, further comprising a fixed cleaning nozzle associated with the air jet screen.

7. A cutting mill in accordance with claim 1 wherein the sizing means comprises an air separator, having blade channels through which cut material below a predetermined, critical weight enters said chamber, cut material of a higher weight than the critical weight being rejected and returned to said cutting chamber for a further cutting operation.

8. A cutting mill in accordance with claim 1 further comprising a closure, which prevents the material to be cut, which is to be introduced into said cutting gap, from flowing back, said closure being arranged in the area in which the material to be cut is fed into the cutting chamber.

* * * * *